US009187977B2

(12) United States Patent
Alvarez et al.

(10) Patent No.: US 9,187,977 B2
(45) Date of Patent: Nov. 17, 2015

(54) SYSTEM AND METHOD FOR STIMULATING A MULTI-ZONE WELL

(75) Inventors: Jose Oliverio Alvarez, Houston, TX (US); Michael T. Hecker, Tomball, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 317 days.

(21) Appl. No.: 13/700,981

(22) PCT Filed: Apr. 25, 2011

(86) PCT No.: PCT/US2011/033803

§ 371 (c)(1), (2), (4) Date: Nov. 29, 2012

(87) PCT Pub. No.: WO2012/011994

PCT Pub. Date: Jan. 26, 2012

(65) Prior Publication Data

US 2013/0062072 A1 Mar. 14, 2013

Related U.S. Application Data

(60) Provisional application No. 61/366,693, filed on Jul. 22, 2010.

(51) Int. Cl.

| | |
|---|---|
| ***E21B 34/00*** | (2006.01) |
| ***E21B 34/06*** | (2006.01) |
| ***E21B 33/12*** | (2006.01) |
| ***E21B 43/08*** | (2006.01) |
| ***E21B 43/14*** | (2006.01) |
| ***E21B 43/26*** | (2006.01) |
| ***E21B 19/16*** | (2006.01) |

(52) U.S. Cl.
CPC ..... *E21B 34/063* (2013.01); *E21B 19/16* (2013.01); *E21B 33/1208* (2013.01); *E21B 43/086* (2013.01); *E21B 43/14* (2013.01); *E21B 43/26* (2013.01)

(58) Field of Classification Search
CPC ..... E21B 34/063
See application file for complete search history.

(56) References Cited

U.S. PATENT DOCUMENTS

| | | | | |
|---|---|---|---|---|
| 2,368,428 | A | | 1/1945 | Saurenman |
| 2,401,035 | A | * | 5/1946 | Akeyson et al. ..... 166/205 |
| 3,289,762 | A | | 12/1966 | Schell |
| 3,371,717 | A | | 3/1968 | Chenoweth |
| 3,735,815 | A | | 5/1973 | Myers |
| 5,398,763 | A | | 3/1995 | Watson et al. |
| 5,431,228 | A | | 7/1995 | Weingarten et al. |
| 5,607,017 | A | * | 3/1997 | Owens et al. ..... 166/288 |
| 5,704,426 | A | | 1/1998 | Rytlewski et al. |
| 5,803,178 | A | | 9/1998 | Cain |

(Continued)

*Primary Examiner* — John Kreck
(74) *Attorney, Agent, or Firm* — ExxonMobil Upstream Research Company Law Dept.

(57) ABSTRACT

A system for stimulating a multi-zone well includes a tubular body apportioned into at least a first zone and a second zone. The system has a first set of plugs placed in pre-drilled holes along the tubular body within the first zone. The plugs in the first set of plugs are fabricated to substantially dissolve upon contact with an acidic stimulation fluid within a first selected time. The system also has a second set of plugs placed in pre-drilled holes along the tubular body within the second zone. The plugs in the second set of plugs are fabricated to substantially dissolve upon contact with the acidic fluid within a second selected time that is greater than the first selected time.

44 Claims, 5 Drawing Sheets

(56) References Cited

U.S. PATENT DOCUMENTS

| | | | | |
|---|---|---|---|---|
| 5,894,888 | A | 4/1999 | Wiemers et al. | |
| 6,047,773 | A | 4/2000 | Zeltmann et al. | |
| 6,378,627 | B1 | 4/2002 | Tubel et al. | |
| 6,394,184 | B2 | 5/2002 | Tolman et al. | |
| 6,491,116 | B2 | 12/2002 | Berscheidt et al. | |
| 6,497,284 | B2 | 12/2002 | van Petegem et al. | |
| 6,520,255 | B2 | 2/2003 | Tolman et al. | |
| 6,543,538 | B2 | 4/2003 | Tolman et al. | |
| 6,543,539 | B1 * | 4/2003 | Vinegar et al. | 166/296 |
| 6,575,247 | B2 | 6/2003 | Tolman et al. | |
| 6,581,681 | B1 | 6/2003 | Zimmerman et al. | |
| 6,672,405 | B2 | 1/2004 | Tolman et al. | |
| 6,755,251 | B2 | 6/2004 | Thomas et al. | |
| 6,843,317 | B2 | 1/2005 | Mackenzie | |
| 6,915,856 | B2 | 7/2005 | Gentry et al. | |
| 6,957,701 | B2 | 10/2005 | Tolman et al. | |
| 7,059,407 | B2 | 6/2006 | Tolman et al. | |
| 7,287,592 | B2 | 10/2007 | Surjaatmadja et al. | |
| 7,287,596 | B2 | 10/2007 | Frazier et al. | |
| 7,357,151 | B2 | 4/2008 | Lonnes | |
| 7,363,967 | B2 | 4/2008 | Burris, II et al. | |
| 7,380,600 | B2 | 6/2008 | Willberg et al. | |
| 7,385,523 | B2 | 6/2008 | Thomeer et al. | |
| 7,467,778 | B2 | 12/2008 | Lonnes | |
| 7,516,792 | B2 | 4/2009 | Lonnes et al. | |
| 7,699,101 | B2 | 4/2010 | Fripp et al. | |
| 7,703,507 | B2 | 4/2010 | Strickland | |
| 7,735,559 | B2 | 6/2010 | Malone | |
| 7,814,970 | B2 | 10/2010 | Strickland | |
| 8,029,026 | B2 | 10/2011 | Stolle et al. | |
| 8,037,934 | B2 | 10/2011 | Strickland | |
| 8,162,051 | B2 | 4/2012 | Strickland | |
| 8,215,385 | B2 * | 7/2012 | Cooke, Jr. | 166/227 |
| 8,272,439 | B2 | 9/2012 | Strickland | |
| 8,342,240 | B2 * | 1/2013 | Richard et al. | 166/205 |
| 2005/0205264 | A1 | 9/2005 | Starr et al. | |
| 2008/0060811 | A1 | 3/2008 | Bour et al. | |
| 2008/0060820 | A1 | 3/2008 | Bour et al. | |
| 2008/0066902 | A1 | 3/2008 | Bullard | |
| 2008/0093073 | A1 | 4/2008 | Bustos et al. | |
| 2008/0156498 | A1 | 7/2008 | Phi et al. | |
| 2008/0257546 | A1 | 10/2008 | Cresswell et al. | |
| 2008/0274918 | A1 | 11/2008 | Quintero et al. | |
| 2008/0302538 | A1 | 12/2008 | Hofman | |
| 2009/0114385 | A1 | 5/2009 | Lumbye | |
| 2009/0294128 | A1 | 12/2009 | Dale et al. | |
| 2010/0122813 | A1 | 5/2010 | Trummer et al. | |
| 2010/0200230 | A1 | 8/2010 | East, Jr. et al. | |
| 2011/0035152 | A1 | 2/2011 | Durocher et al. | |
| 2011/0048122 | A1 | 3/2011 | Le Foll et al. | |

* cited by examiner

SYSTEM AND METHOD FOR STIMULATING A MULTI-ZONE WELL

CROSS-REFERENCE TO RELATED APPLICATION

This application is the National Stage of International Application No. PCT/US2011/033803, filed Apr. 25, 2011, which claims the benefit of U.S. Provisional Patent Application 61/366,693 filed Jul. 22, 2010 entitled SYSTEM AND METHOD FOR STIMULATING A MULTI-ZONE WELL, the entirety of which is incorporated by reference herein.

FIELD OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

The present inventions relate to the field of wellbore completions. More specifically, the inventions relate to systems and methods for isolating selected zones along a wellbore to facilitate the stimulation of those zones for the injection of acid.

BACKGROUND

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation.

A cementing operation is typically conducted in order to fill or "squeeze" the annular area with cement. This serves to form a cement sheath. The combination of cement and casing strengthens the wellbore and facilitates the isolation of the formations behind the casing.

It is common to place several strings of casing having progressively smaller outer diameters into the wellbore. Thus, the process of drilling and then cementing progressively smaller strings of casing is repeated several or even multiple times until the well has reached total depth. The final string of casing, referred to as a production casing, is cemented into place. In some instances, the final string of casing is a liner, that is, a string of casing that is not tied back to the surface, but is hung from the lower end of the preceding string of casing.

In some instances, a well may be completed as an open-hole completion. This means that the final tubular body run into the wellbore is not cemented into place; instead, a perforated liner may be installed. Where the producing formation is located in a sandstone or other loose or unconsolidated formation, a sand screen may alternatively be used. A production string or "tubing" is then positioned inside the wellbore extending down to the last string of casing.

There are certain advantages to open-hole completions versus cased hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation.

Second, open-hole completions, including gravel pack techniques, are oftentimes less expensive than cased hole completions. For example, the use of perforated liners and gravel packs eliminates the need for cementing, perforating, and post-perforation clean-up operations.

As an additional step in the wellbore completion process, production equipment such as tubing, packers and pumps may be installed within the wellbore. A wellhead (or "tree") is installed at the surface along with fluid gathering and processing equipment. Production operations may then commence.

Before beginning production, it is sometimes desirable for the drilling company to "stimulate" the formation by injecting an acid solution through the casing. This is particularly true when the formation comprises carbonate rock. In operation, the drilling company injects a concentrated formic acid or other acidic composition into the wellbore, and directs the fluid along and even into the near-wellbore region. This is known as acidizing. The acid helps to dissolve carbonate material, thereby opening up porous channels through which hydrocarbon fluids may flow into the wellbore. In addition, the acid helps to dissolve drilling mud that may have invaded the formation. Acid stimulation as described above is a routine part of petroleum industry operations.

In many wellbores, it is now common to complete a well through multiple zones of interest. Such zones may represent up to about 30 meters (100 feet) of gross, vertical thickness of subterranean formation. When there are multiple or layered reservoirs to be hydraulically fractured, or a very thick hydrocarbon-bearing formation, then more complex treatment techniques may be required to obtain treatment of the entire target zone. In this respect, the drilling company must isolate various zones to ensure that each separate zone is adequately treated. In this way the operator is sure that stimulation fluid is being injected into each zone of interest or along the entire zone of interest to effectively increase the flow capacity at each desired depth.

To do this, various fluid diversion techniques may be employed. Two general categories of fluid diversion have been developed to help ensure that the acid reaches the desired rock matrix—mechanical and chemical. Mechanical diversion involves the use of a physical or mechanical diverter that is placed within the wellbore. Chemical diversion, on the other hand, involves the injection of a fluid or particles along and into the formation itself.

Referring first to chemical diverters, chemical diverters include foams, particulates, gels, and viscosified fluids. Foam commonly comprises a dispersion of gas and liquid wherein a gas is in a non-continuous phase and liquid is in a continuous phase. Where acid is used as the liquid phase, the mixture is referred to as a foamed acid. In either event, as the foam mixture is pumped downhole and into the porous medium that comprises the original, more permeable formation, additional foam is generated. The foam initially builds up in the areas of high permeability until it provides enough resistance to force the acid into the new zone of interest having a lower permeability. The acid is then able to open up pores and channels in the new formation.

Particulate diverters consist of fine particles. Examples of known particulate diverters are cellophane flakes, oyster shells, crushed limestone, gilsonite, oil-soluble naphthalenes, and even chicken feed. Within the last several years, solid organic acids such as lactic acid flakes have been used. As the particles are injected, they form a low permeability filter-cake on the face of wormholes and other areas of high permeability in the original formation. This then forces acid treatment to enter the new zone(s) of interest. After the acidizing treatment is completed, the particulates hydrolyze in the presence of water and are converted into acid.

Viscous diverters are highly viscous materials, sometimes referred to as gels. Gels use either a polymer or a viscoelastic surfactant (VES) to provide the needed viscosity. Polymer-based diverters crosslink to form a viscous network upon reaction with the formation. The crosslink breaks upon continued reaction and/or with an internal breaker. VES-based diverters increase viscosity by a change in micelle structure upon reaction with the formation. As the high-viscosity material is injected into the formation, it fills existing wormholes. This allows acid to be injected into areas of lower permeability higher in the wellbore. The viscosity of the gel breaks upon exposure to hydrocarbons (on flowback) or upon contact with a solvent.

Chemical diverters may have limited effectiveness in certain situations. For example, if the density of the acid and the diverting fluid is considerably different, or if the wellbore significantly deviates from vertical, the interface of the acid with the diverter may break down or experience distortion while traveling down the wellbore. In some cases, this distortion may involve the mixing of acid and an acid-containing diverter. This, in turn, reduces the viscosity of the diverter, thereby reducing the diverter effectiveness and the overall performance of the stimulation job. Depending on stage size, fluid density, fluid viscosity, and pumping rate, the interface distortion may be severe.

Referring now to mechanical diverters, various types of mechanical diverters have been employed. These generally include ball sealers, plugs, and straddle packers. For example, U.S. Pat. No. 3,289,762 uses a ball that seats in a baffle to cause mechanical isolation. U.S. Pat. No. 5,398,763 uses a wireline to set and then to retrieve a baffle. The baffle isolates a portion of a formation for the injection of fluids. U.S. Pat. No. 6,491,116 provides a fracturing plug, or "frac plug." Frac plugs are common in the industry and rely upon a ball that is either dropped from the surface to land on a seat, or that is integral to the plug itself. Frac plugs generally require a wireline for setting. Frac plugs may also be retrieved via wireline, although in some instances frac plugs have been fabricated from materials that can be drilled out. Drilling out the material adds time and expense to the stimulation operation.

Mechanical plugs are used to isolate an interval after successfully stimulating each zone. Although the stimulation of each zone separately can be very effective, multiple electric line runs and acid stimulations may be required to fully stimulate a long interval, increasing the time and cost of the acid treatment. Further, while mechanical plugs can provide high confidence that formation treatment fluid is being diverted, there is a risk of incurring high costs due to mechanical and operational complexity of the plugs. Plugs may become stuck in the casing resulting in a lengthy and costly fishing operation. If unsuccessful, a drill rig may be needed to be brought on-sight to drill the plug out. Drilling out the plug is not preferred due to the time and cost associated with mobilizing a drill rig on location. In some situations, the well may have to be sidetracked or even abandoned. Mechanical plugs particularly have a history of reliability issues in large diameter wells. In this respect, it can be difficult to locate a plug suitable for a large borehole, and those that are available have a history of failures.

A need therefore exists for an acid diverting system and method that offers the reliability of a mechanical plug without the risk of mechanical failure or sticking. Further, a need exists for a system that optimizes the acid circulation process by removing the need for a wireline, and yet has greater reliability than a viscous chemical diverter. A need further exists for a system that improves the stimulation of a formation along the entire length of a deviated, open-hole wellbore.

SUMMARY

A system is provided for stimulating a multi-zone well. The system first includes a pre-perforated tubular body. The tubular body is dimensioned to be received within a wellbore. In one aspect, the tubular body is a liner made up of a plurality of joints.

The tubular body comprises pre-drilled holes placed along a wall of the tubular body. The holes may be arranged in repeating patterns. The tubular body is also apportioned into at least a first zone and a second zone. Optionally, a third zone (and additional zones) may also be provided. The tubular body extends at least 10 feet (3.0 meters) along each of the first, second, and third zones. Preferably, the third zone has a measured depth that is less than the second zone, while the second zone has a measured depth that is less than the first zone. However, the inverse may apply.

The wellbore may be completed substantially vertically. Alternatively, the wellbore may be completed as a deviated wellbore. In one aspect, the deviated wellbore is completed to have a substantially horizontal portion such that the horizontal portion has a heel and a toe. In one aspect, the first zone resides at the toe of the horizontal portion of the wellbore.

The system has at least two sets of dissolvable plugs. A first set of plugs is placed in holes along the pre-perforated tubular body within the first zone. The plugs in the first set of plugs are fabricated to substantially dissolve upon contact with an acidic stimulation fluid within a first selected time. A second set of dissolvable plugs is placed in holes along the tubular body within the second zone. The plugs in the second set of plugs are fabricated to substantially dissolve upon contact with the acidic fluid within a second selected time that is greater than the first selected time. A third set of dissolvable plugs is optionally placed in holes along the tubular body within a third zone. The plugs in the third set of plugs are fabricated to substantially dissolve upon contact with the acidic fluid within a third selected time that is greater than the second selected time. Alternatively, holes placed along the third zone may not have plugs.

The acidic fluid may comprise, for example, hydrochloric acid, acetic acid, or formic acid. The acid is used to clean drilling mud damage and stimulate the reservoir rock before the well is brought on line for production.

In one preferred aspect of the system, the pre-perforated tubular body further comprises a fourth zone. The fourth zone has a measured depth that is greater than the first zone, and resides at the toe of the horizontal portion of the wellbore. The holes in the tubular body along the fourth zone do not have the dissolvable plugs. In this way, an initial injection of stimulation fluid immediately enters the near-wellbore region adjacent to the fourth zone.

Concerning the plugs, in one embodiment each dissolvable plug is fabricated to have a central body. The central body has a diameter that is dimensioned to closely fit within a diameter of a respective pre-drilled hole in the tubular body. In addition, each plug has a top end. The top end has a diameter that is larger than the diameter of the respective hole in the tubular body. In addition, each plug has a bottom end. The bottom end has a diameter that is at least as large as the diameter of the respective pre-drilled hole in the tubular body. The bottom end is preferably partially fabricated from an elastomeric material so that it may be compressed and inserted through the respective hole.

A method of stimulating a multi-zone well using an acidization treatment is also provided herein. In one embodiment, the method includes setting a pre-perforated tubular body in a wellbore. The tubular body preferably comprises a plurality of joints, and is dimensioned to be received within a wellbore. The tubular body may be, for example, a liner.

The tubular body comprises a plurality of perforations, or holes, pre-drilled into a wall of the tubular body. The holes may be arranged in repeating patterns along the tubular body. The tubular body is also apportioned into at least a first zone and a second zone. Optionally, the tubular body may be further apportioned into a third zone.

The tubular body includes a first set of dissolvable plugs. These plugs are placed in the holes along the tubular body within the first zone. Each of the plugs in the first set of plugs is fabricated to substantially dissolve upon contact with an acidic stimulation fluid within a first selected time.

The tubular body also includes a second set of dissolvable plugs. These plugs are placed in the holes along the tubular body within the second zone. Each of the plugs in the second set of plugs is fabricated to substantially dissolve upon contact with the acidic stimulation fluid within a second selected time that is greater than the first selected time.

The pre-perforated tubular body may further include a third set of dissolvable plugs. These plugs are placed in the holes along the tubular body within the third zone. Each of the plugs in the third set of plugs is fabricated to substantially dissolve upon contact with the acidic stimulation fluid within a third selected time that is greater than the second selected time.

The method also includes injecting an acidic solution into the well under pressure. The acidic fluid may be, for example, hydrochloric acid or formic acid. Injecting the acidic solution causes the first set of plugs to dissolve. This exposes a subsurface formation outside of the tubular body along the first zone. This further insures that the formation along the first zone is adequately treated without concern that some acidic fluid will be lost along the second and third zones.

The method further includes injecting the acidic solution into the well under pressure so as to dissolve the second set of plugs. Injecting the acidic solution causes the second set of plugs to dissolve. This, in turn, exposes a subsurface formation outside of the tubular body along the second zone.

Where a third zone is provided along the tubular body, the method also includes further injecting the acidic solution into the well under pressure so as to dissolve the third set of plugs. Injecting the acidic solution causes the third set of plugs to dissolve. This, in turn, exposes a subsurface formation outside of the tubular body along the third zone.

Preferably, the third zone has a measured depth that is less than the second zone, and the second zone has a measured depth that is less than the first zone. However, the inverse may apply.

The wellbore may be completed substantially vertically. Alternatively, the wellbore may be completed as a deviated wellbore. In one aspect, the deviated wellbore is completed to have a substantially horizontal portion such that the horizontal portion has a heel and a toe.

In one aspect, the tubular body further comprises a fourth zone. Note that the term "fourth", and similar numeric indicators used herein, are merely used herein to simplify illustration and discussion purpose only, as in relation to the exemplary embodiments discussed herein. Same for such terms as used in the claims. Such numeric terms are not intended to be defined narrowly in relation to only a specific and sequential set of only such zones, nor does they indicate that there are only such number of zones in the wellbore.

In still other aspects, the wellbore contains a fourth or additional zone. Such zone merely has a measured depth that is greater than the first zone, and for illustration purposes, resides at or near the toe of a horizontal portion of the wellbore. The holes in the tubular body along the fourth zone do not have plugs. The method then further comprises injecting the acidic solution into the well under pressure so as to expose a subsurface formation along or near the toe of the wellbore to an acid solution before the acidic solution contacts the subsurface formation along at least the first (or other) zone.

In another aspect, the inventive methods include performing a wellbore fluid swap while the annulus is open or not yet packed off, by circulating or otherwise introducing weak-acid or substantially non-reactive fluids (e.g., fluids that do not substantially immediately stimulate the formation or react substantially with the completion component materials) into the well such as over the full or partial length of the completion section of the wellbore. Such process may leave the wellbore conditioned or otherwise prepared for more substantial and reactive acid or other stimulation. It is understood that in the presence of swellable packers such fluids are circulated before the packers completely swell.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

FIG. 2A is a cross-sectional view of a portion of the pre-perforated liner.

FIG. 2B is a perspective view of the portion of the pre-perforated liner of FIG. 2A.

FIG. 4A is a top view; FIG. 4B is a bottom view; and FIG. 4C is a side cross-sectional view.

In FIG. 5A, perforations or holes are shown along the pre-perforated liner.

In FIG. 5B, dissolvable plugs have been installed into the holes.

DETAILED DESCRIPTION

Definitions

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring, hydrocarbons including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "condensable hydrocarbons" means those hydrocarbons that condense at about 15° C. and one atmosphere absolute pressure. Condensable hydrocarbons may include, for example, a mixture of hydrocarbons having carbon numbers greater than 4.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone of interest" or "interval" refers to a portion of a formation containing hydrocarbons.

As used herein, the term "wellbore" refers to a hole in the subsurface made by drilling or insertion of a conduit into the subsurface. A wellbore may have a substantially circular cross section, or other cross-sectional shapes. As used herein, the term "well", when referring to an opening in the formation, may be used interchangeably with the term "wellbore."

The term "tubular member" refers to any pipe, such as a joint of casing, a portion of a liner, or a pup joint.

The term "perforation" includes a pre-drilled hole or slot placed in a tubular body.

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Figure 1:
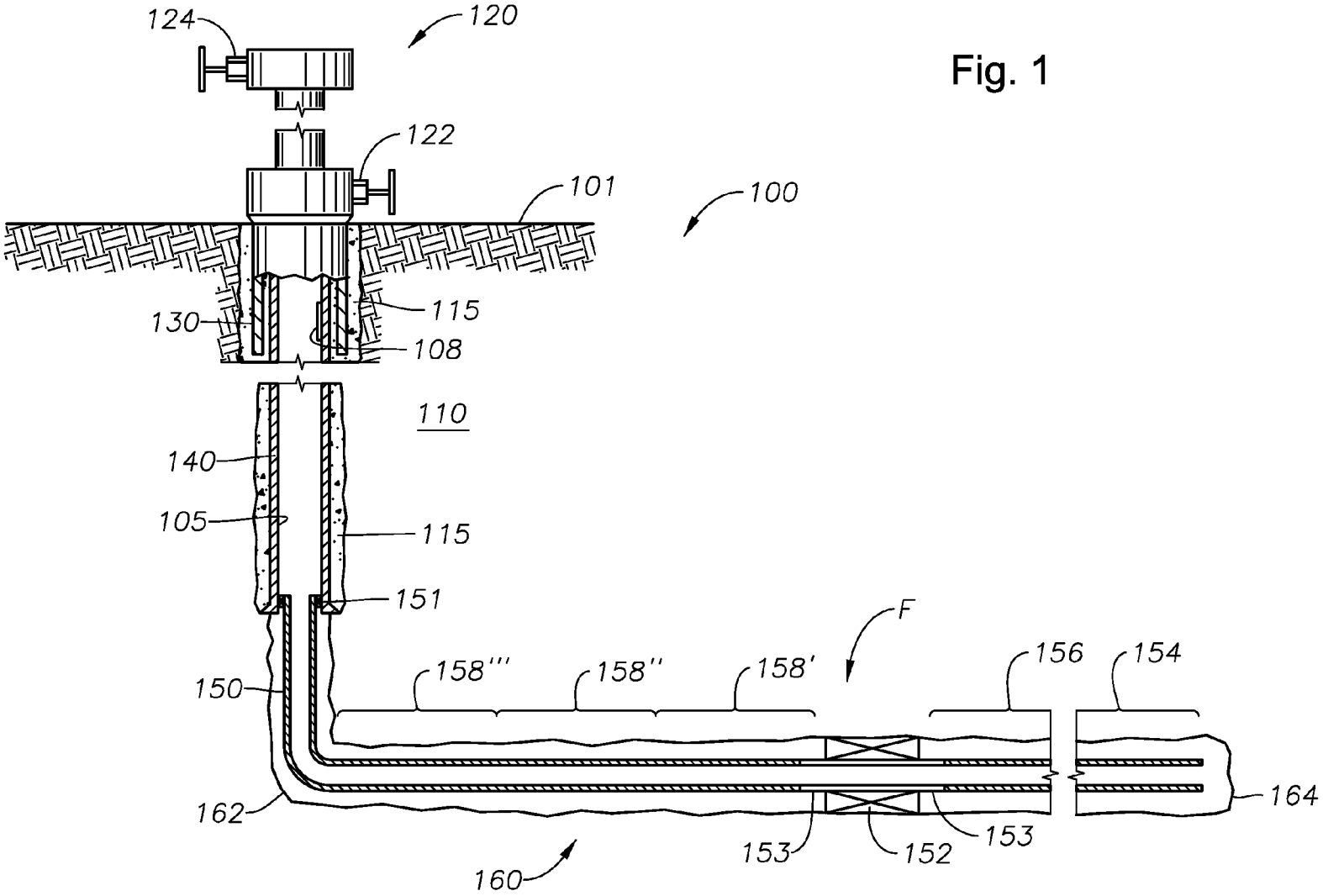
FIG. 1 is a cross-sectional view of an illustrative wellbore. The wellbore has been completed substantially horizontally, as an open-hole completion. The horizontal portion of the wellbore is directed through a subsurface interval that contains hydrocarbon fluids.

FIG. 1 is a cross-sectional view of an illustrative wellbore 100. The wellbore 100 defines a bore 105 that extends from a surface 101, and into the earth's subsurface 110. The bore 105 preferably includes a shut-in valve 108. The shut-in valve 108 controls the flow of production fluids from the wellbore 100 in the event of a catastrophic event at the surface 101.

The wellbore 100 includes a wellhead, shown schematically at 120. The wellhead 120 contains various items of flow control equipment such as a lower master fracturing valve 122 and an upper master fracturing valve 124. It is understood that the wellhead 120 will include other components during the formation and completion of the wellbore 100, such as a blowout preventer (not shown).

The wellbore 100 has been completed by setting a series of pipes into the subsurface 110. These pipes include a first string of casing 130, sometimes known as surface casing or a conductor. These pipes also include a final string of casing 150, known as a production casing. The pipes also include one or more sets of intermediate casing 140. Typically, the surface 130 and intermediate 140 strings of casing are set in place through cement 115.

Referring specifically to the production casing 150, the production casing 150 may also be set in place using a cement sheath 115. However, in the illustrative wellbore arrangement of FIG. 1, the production casing 150 is set as an open hole completion. Further, the production casing 150 defines a pre-perforated liner. The liner 150 is hung from the bottom of the intermediate casing string 140 using a liner hanger 151.

The illustrative wellbore 100 is completed horizontally. A horizontal portion is shown at 160. The horizontal portion 160 has a heel 162. The horizontal portion 160 also has a toe 164 that extends through a hydrocarbon-bearing interval. While the wellbore 100 is shown as a horizontal completion, it is understood that the present inventions have equal application in vertical wells or in deviated wells that extend through multiple formations or zones of interest.

In FIG. 1, the horizontal portion 160 of the wellbore 100 extends laterally through a formation "F." Preferably, the formation "F" is a carbonate or sand formation having good consolidation. However, the formation "F" may alternatively be a sand formation or other formation that is unconsolidated. In such instances, a gravel pack and/or sand screen may be used.

The wellbore 100 also includes at least one packer 152. The at least one packer 152 is placed along the outer diameter of the liner 150. In the arrangement of FIG. 1, the packer 152 is a swellable packer. Such a packer 152 has benefit to the operator when running a production logging tool ("PLT").

Swellable packers are known, and include at least one swellable packer element fabricated from a swelling elastomeric material. Suitable examples of swellable materials may be found in Easy Well Solutions' CONSTRICTOR™ or SWELLPACKER™, and Swellfix's E-ZIP™. The thickness and length of the swellable packer 152 must be able to expand to the wellbore wall and provide the required pressure integrity at that expansion ratio. The swellable packer 152 may be fabricated from a combination of materials that swell in the presence of both water and oil, respectively. Stated another way, the swellable packer element 152 may include two types of swelling elastomers—one for water and one for oil. In this situation, the water-swellable element will swell when exposed to the water-based drilling fluid or formation water, and the oil-based element will expand when exposed to hydrocarbon production.

Swellable elastomeric materials may include, for example, natural rubber; acrylate butadiene rubber; polyacrylate rubber; isoprene rubber; choloroprene rubber; butyl rubber; brominated butyl rubber; chlorinated butyl rubber; chlorinated polyethylene; neoprene rubber; styrene butadiene copolymer rubber; ethylene vinyl acetate copolymer; silicone rubbers; nitrile rubber; and many other swellable elastomeric materials. The swelling elastomeric material may be determined to swell in the presence of one of a conditioned drilling fluid, a completion fluid, a production fluid, an injection fluid, a stimulation fluid, or any combination thereof However, the present inventions are not limited to the particular design of the packer 152.

In completing the wellbore 100 for the production of hydrocarbons, the operator may wish to stimulate the formation "F" by circulating an acid solution. This serves to clean out residual drilling mud both along the wall of the borehole 105 and into the near-wellbore region (the region within formation "F" close to the production casing 150). However, and as noted above, known methods present technical difficulties, particularly in horizontal or highly deviated wells. Chemical diverters tend to mingle with the acid, making it difficult if not impossible to ensure that the entire formation is adequately treated; mechanical diverters can become stuck and oftentimes require numerous and time consuming trips in and out of the wellbore 100 with wirelines, setting tools, plugs, and other devices.

In addition, with long horizontal and highly deviated wells, the pressure differential along the wellbore makes it difficult to inject the acid treatment evenly. In this respect, the hydrostatic head formed by the fluid creates a high pressure at the heel 162 of the horizontal (or deviated) portion 160, while friction losses substantially reduce the pressure at the toe 164 of the horizontal portion 160. This pressure differential is particularly marked when the horizontal (or deviated) portion 160 is long, such as greater than 3,000 feet (914 meters), or even over 10,000 feet (3,048 meters).

To address these concerns, novel systems and methods are offered herein. Particularly, a pre-perforated tubular body is employed having small plugs (seen at 300 in FIG. 3) that are tuned to dissolve in the presence of acid over selected periods of time. Such plugs 300 carry the benefits of a chemical diverter in that they do not require repeated trips in and out of the wellbore 100 with a wireline and an expensive mechanical device and they cannot become permanently stuck in the wellbore 100. This removes the possibility of failure and subsequent fishing operations. At the same time, they carry the benefits of a mechanical plug in that they cannot be "bypassed" and do not require the injection of staged chemicals.

Figure 2A:
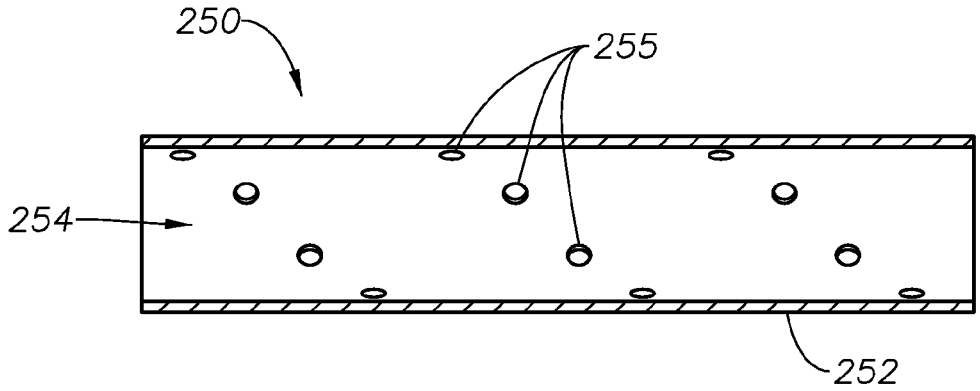
FIGS. 2A and 2B show a pre-perforated liner as may be used in the acidization systems and methods of the present inventions, in one embodiment.
Figure 2B:
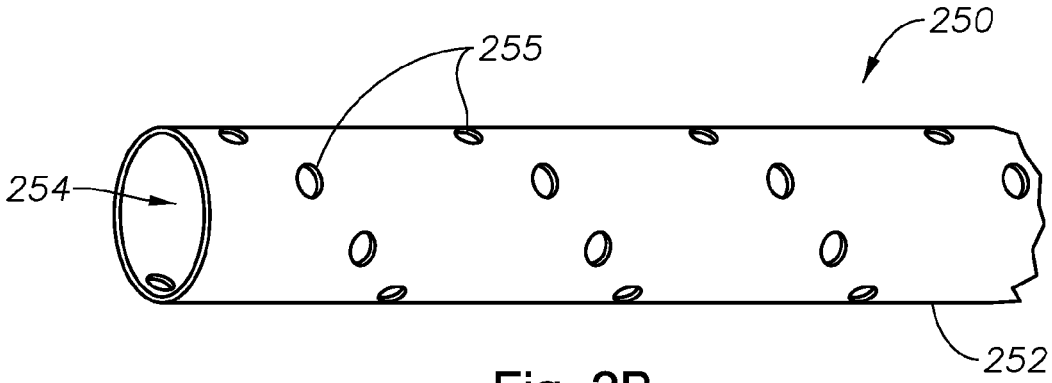

FIGS. 2A and 2B show a pre-perforated liner 250 as may be used in the acidization systems and methods of the present inventions, in one embodiment. FIG. 2A is a cross-sectional view of a portion of the pre-perforated liner 250. FIG. 2B is a perspective view of the portion of liner 250 of FIG. 2A. The liner 250 is one embodiment of the tubular body and is used as the production casing 150 of FIG. 1. The liner 250 will be discussed with reference to both FIGS. 2A and 2B.

The liner 250 is a cylindrical body having a wall 252. The wall 252 defines a bore 254 running therethrough. In addition, the liner 250 has a plurality of pre-drilled holes 255. Preferably, the holes 255 are of the same diameter, and are spaced equi-distantly apart. The holes 255 may optionally be arranged in repeating patterns, such as the one shown in FIGS. 2A and 2B.

It is understood that the liner 250 is actually an elongated tubular body. The liner 250 is preferably made up of a plurality of joints in order to extend hundreds and perhaps thousands of feet through one or more subsurface zones of interest. The liner 250 may be interrupted by one or more packers, such as swellable packer 152. In this case, the liner 250 may further be interrupted by short sections of blank pipe 153 on either end of the packer 152.

Figure 3:
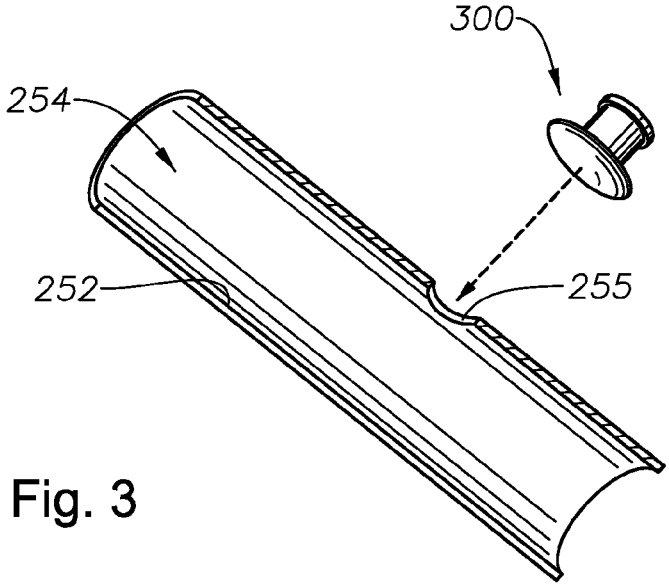
FIG. 3 is a cut-away view of a small section of the pre-perforated liner of FIGS. 2A and 2B. Here a hole is shown receiving a dissolvable plug.

The holes 255 in the liner 250 are dimensioned to receive a dissolvable plug 300. FIG. 3 provides a cut-away view of a section of the pre-perforated liner 250 of FIGS. 2A and 2B. Here a hole or perforation 255 is seen receiving the dissolvable plug 300.

Figure 4A:
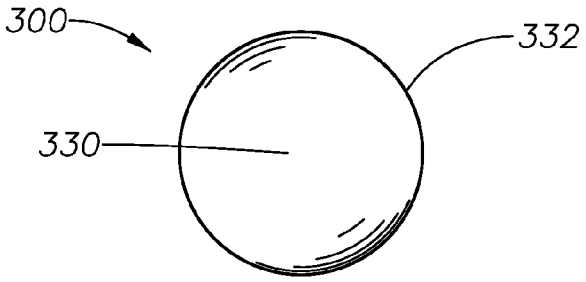
FIGS. 4A, 4B, and 4C demonstrate additional views of the dissolvable plug of FIG. 3.
Figure 4B:
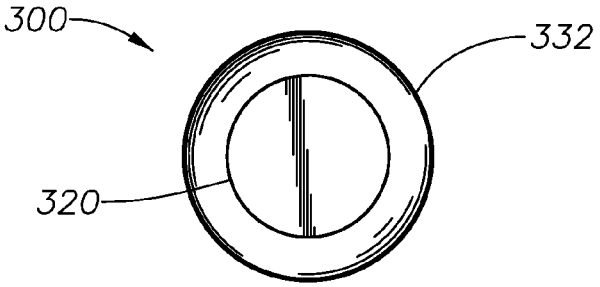
Figure 4C:
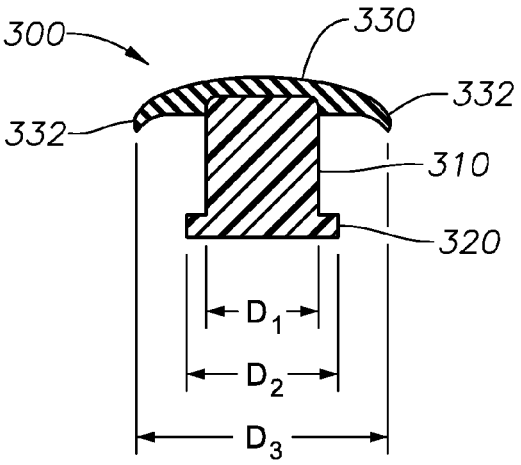

FIGS. 4A, 4B, and 4C provide various views of the dissolvable plug 300 of FIG. 3, in one embodiment. FIG. 4A provides a top view of the plug 300, while FIG. 4B shows a bottom view of the plug 300. FIG. 4C presents a side view of the plug 300. The plug 300 will be described with reference to FIGS. 4A, 4B, and 4C, together.

The plug 300 has a central body 310. The central body 310 has a diameter $D_1$ that is dimensioned to closely slide and fit into the holes 255. The central body 310 is preferably a substantially rigid, cylindrical body. In another embodiment, the central body 310 may be covered by or be made of elastomeric material.

The plug 300 also has a top end 320. The top end 320 is arranged as a small, rigid disc that is connected to the central body 310 at one end. The top end 320 has a diameter $D_2$ that is slightly greater than diameter $D_1$. In addition, diameter $D_2$ is dimensioned to be larger than the diameter of the pre-drilled holes 255. In this way, the top end 320 will rest on an outer surface of the liner 250.

The plug 300 also has a bottom end 330. The bottom end 330 is also arranged as a small, rigid disc, and is connected to the central body 310 at an end opposite the top end 320. The bottom end 330 has a diameter $D_3$ that is slightly greater than diameter $D_2$. In addition, the bottom end 330 includes a circular wing or edge 332, fabricated from a flexible, elastomeric material. The elastomeric nature of the edge 332 allows the bottom end 330 to be compressed and placed through a pre-drilled hole 255. Optionally, the entire bottom end 330 is fabricated from a thin, highly elastomeric material.

Figure 4D:
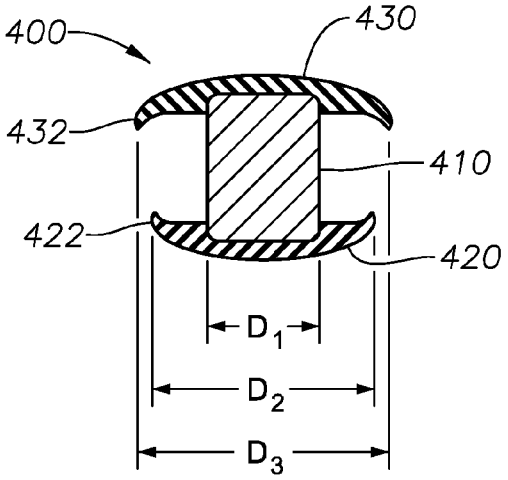
FIG. 4D provides a side, cross-sectional view of a dissolvable plug in an alternate embodiment. Here, both the top and bottom portions of the plug are fabricated from an elastomeric material.

FIG. 4D provides a side, cross-sectional view of a dissolvable plug 400 in an alternate embodiment. As with plug 300, plug 400 has a central body 410. The central body 410 has a diameter $D_1$ that is dimensioned to closely slide and fit into the holes 255. The central body 410 is preferably a substantially rigid, cylindrical body.

The plug 400 also has a top end 420. The top end 420 is arranged as a small, rigid disc that is connected to the central body 410 at one end. The top end 420 has a diameter $D_2$ that is slightly greater than diameter $D_1$. In addition, diameter $D_2$ is dimensioned to be at least as large as the diameter of the pre-drilled holes 255. In this way, the top end 420 will rest on an outer surface of the liner 250. In addition, the top end 420 includes a circular wing or edge 422, fabricated from a flexible, elastomeric material.

The plug 400 also has a bottom end 430. The bottom end 430 is also arranged as a small, rigid disc, and is connected to the central body 410 at an end opposite the top end 420. The bottom end 430 has a diameter $D_3$ that optionally is slightly greater than diameter $D_2$. In addition, the bottom end 430 includes a circular wing or edge 432, fabricated from a flexible, elastomeric material. The elastomeric nature of the edge 432 allows the bottom end 430 to be compressed and placed through a pre-drilled hole 255.

The elastomeric material at the top 420 and bottom 430 ends of the plug 400 are fabricated from a material that will dissolve in the presence of an acidic fluid. It is acknowledged in FIG. 4 that the top end 420 is shown at the bottom of the plug 400, and that the bottom end 430 is shown at the top of the plug 400. It is understood though that the bottom end 430 will be inserted into a hole 255, such that it may operate as a bottom end. However, in the arrangement of FIG. 4, the ends 420, 430 are essentially interchangeable.

Figure 5A:
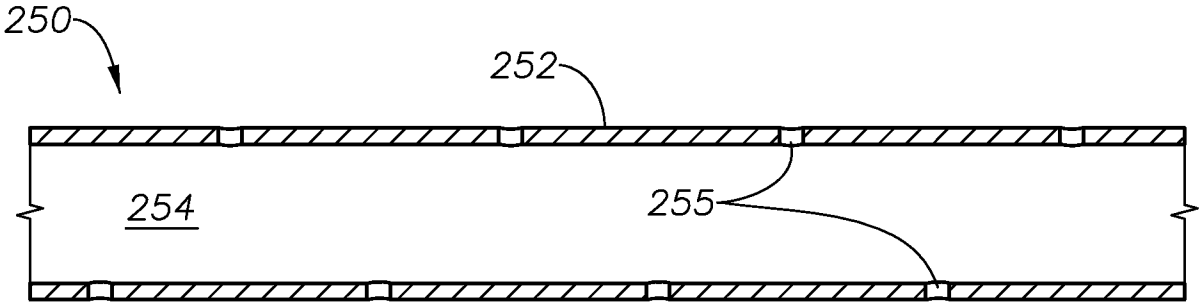
FIGS. 5A and 5B are additional views of the pre-perforated liner of FIGS. 2A and 2B. Each view is a cross-sectional side view.
Figure 5B:
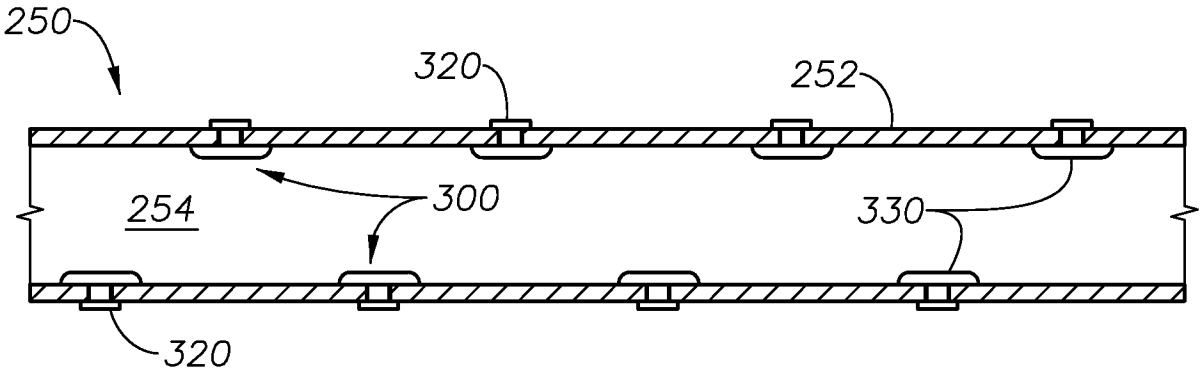

FIGS. 5A and 5B are additional views of the pre-perforated liner 250 of FIGS. 2A and 2B. Each view is a cross-sectional side view. In FIG. 5A, open perforations 255 (or holes) are shown along the liner 250. In FIG. 5B, dissolvable plugs 300 have been installed into the plurality of holes 255. In each view, the bore 254 is visible.

It can be seen in FIG. 5B that the top end 320 of each of the plugs 300 is residing along an outer surface of the liner 250. It can further be seen in FIG. 5B that the bottom end 330 of each of the plugs 300 is residing along an inner surface of the liner 250. The plugs 300 are installed into the holes 255 manually.

The plugs 300 are fabricated from a material that will dissolve in the fluid making up the acid solution. An example of an acidic fluid is a fluid comprised of about 15% to 50% hydrochloric acid or formic acid. The current methods are not limited by the nature of the acidic composition. Examples of suitable material for dissolving in the acidic fluid include sodium bicarbonate, calcite rock, chalk rock, or combinations thereof.

In accordance with the present inventions, and as noted above, the plugs 300 are "tuned" to dissolve in the fluid making up the acid solution according to a selected time. In this way, the portion of the formation "F" closest to the heel 162 of the deviated portion 160 of a wellbore 100 may be isolated from a portion of the formation "F" at the toe 164 of the wellbore 100, and even intermediate portions of the formation "F."

It can be seen in FIG. 1 that the horizontal portion 160 of the wellbore 100 has been apportioned into a plurality of zones. The zone at the toe 164 is indicated as zone 154. The next zone closest to the heel 162 is indicated as zone 156. Additional zones progressing sequentially closer to the heel 162 of the deviated portion 160 are indicated as zones 158', 158", etc. It is noted that in this context, the term "zone" means a selected length of the tubular body 150, as opposed to a discrete geological feature or a defined subsurface interval.

In operation, the liner 150 along zone 154 will simply be a pre-perforated liner 250 without plugs 300. This is shown in the illustrative view of FIG. 5A. Next, the holes (such as holes 255) within the liner 150 along zone 156 will have plugs 300. These plugs 300 are fabricated to dissolve at various times that can vary from about five minutes to over ten hours after exposure to an acidic stimulation fluid.

In one aspect, the holes 255 within the liner 150 along zone 154 may also have plugs 300. In that instance, the plugs 300 along zone 154 will be fabricated to dissolve very quickly, such as within ten minutes, or even five minutes, in the presence of the acidic stimulation fluid. Then, the plugs 300 along zone 156 will be fabricated to dissolve more slowly than the plugs 300 along zone 154, to allow zone 154 to obtain the desired amount of acidic fluid. For example, the plugs 300 along zone 156 may be tuned to dissolve within about 15 to 60 minutes.

As shown in FIG. 1, multiple additional zones 158', 158", etc. may be provided. Each of these zones 158', 158", etc. has plugs 300 that have different material characteristics. In this respect, the plugs 300 in each zone 158', 158", etc. are fabricated to dissolve more slowly than the plugs 300 in the preceding zone to allow preceding zones to obtain the desired amount of acidic fluid. Thus, for example, each of the plugs 300 along zone 158' is fabricated to dissolve more slowly than each of the plugs 300 in zone 156. Similarly, each of the plugs 300 along zone 158'" is fabricated to dissolve more slowly than the plugs 300 in zone 158", and so forth.

In order to adjust the dissolution rate of various sets of plugs 300, an outer layer may be provided over the plugs 300 to delay the reaction with the acidic fluid and the dissolving of the plugs 300 in the wellbore 100. Examples of suitable coating material are polyester, polycarbonates, polylactic acid, nylon, cellulose, starch, acrylonitrile, polyurethane, and polyacrylate. The thicker the coating along the outer layer, the more slowly a particular plug will dissolve. In one aspect, plugs 300 along zone 158'" (representing a zone closest to the heel 162) may be coated such that the plugs 300 will not begin to dissolve until after about 30 minutes, or even three hours, of exposure to an acidic fluid.

It is preferred that the coating material be elastomeric in nature. This enables the bottom end 330 of each plug 300 to be folded or compressed, and then inserted through corresponding perforations 255. Depending on the composition of the elastomeric material and the volume percent of acid in the stimulation fluid, a 0.5 mm thickness of coating may represent a 5 minute delay.

In addition to the use of a coating, or alternatively, the amount of material used in the bottom end 330 of the various plugs 300 may be adjusted. Where a set of plugs 300 is intended to dissolve more slowly, then the amount of dissolvable material in the bottom end 330 may be increased. In general, the dimensions, density, shape and amount of material may be selected to meet specific operational needs.

As another way of adjusting dissolution rates, the spacing between perforations 255 (or holes) may be adjusted. In FIGS. 5A and 5B, the perforations 255 are shown more or less equi-distantly spaced. However, variations in spacing may be employed. For example, the perforations in the tubular body 200 may have a different spacing along the third zone as compared to the perforations along the first zone. Alternatively, the hole spacings may be different in each zone.

As yet another way of adjusting dissolution rates, the diameter of the holes 255 may be adjusted. In FIGS. 5A and 5B, the holes 255 are shown as being uniform in size. However, variations in diameter may be employed. For example, the perforations in the tubular body 200 may have a larger diameter along the first zone as compared to the diameter of the perforations along the second zone or the third zone.

Figure 6:
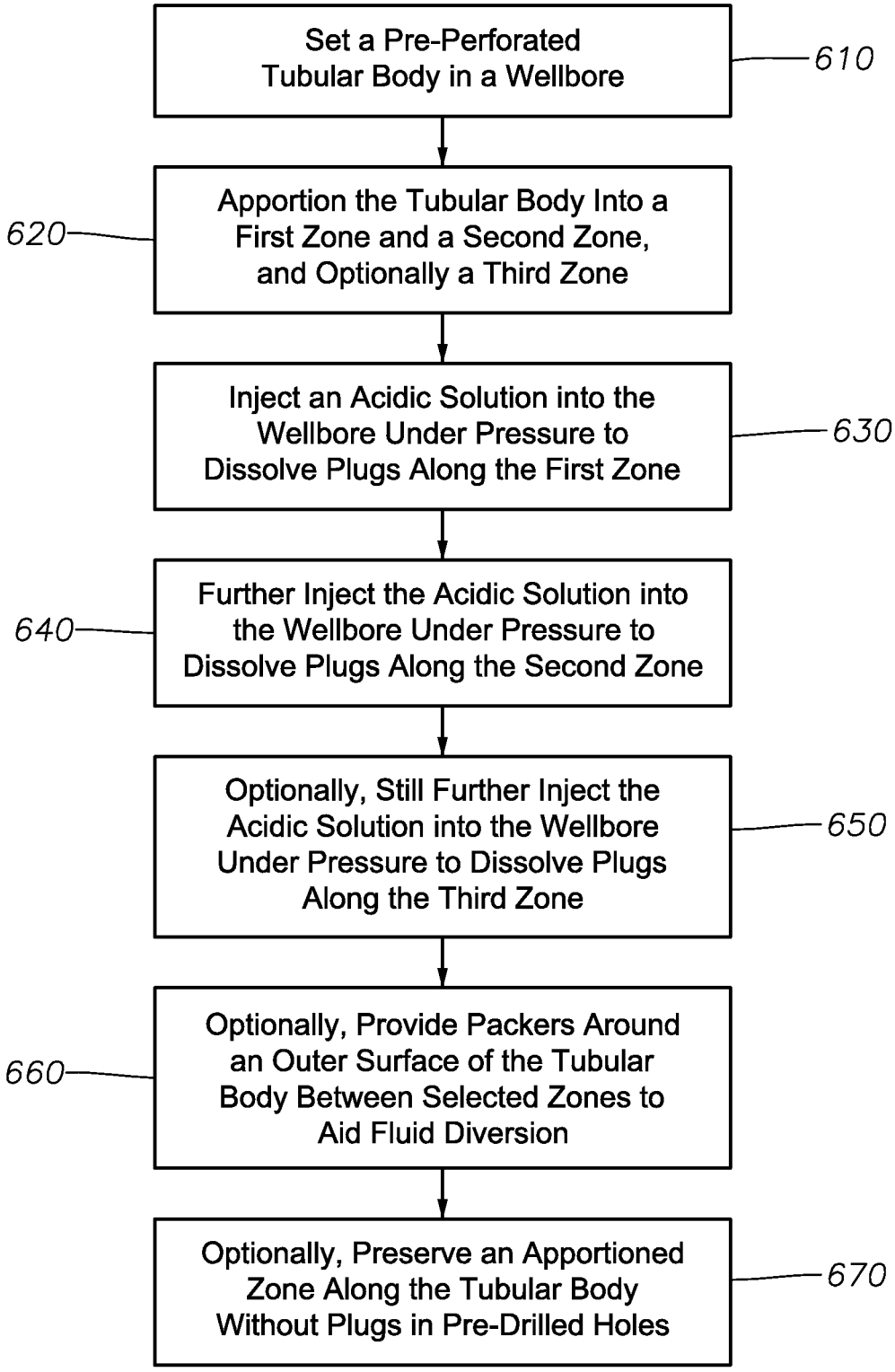
FIG. 6 is a flowchart demonstrating steps of a method for stimulating a multi-zone well, in one embodiment.

A method of stimulating a multi-zone well using an acidization treatment is also provided herein. FIG. 6 presents steps for such a method 600, in one embodiment.

The method includes setting a pre-perforated tubular body in a wellbore. This is shown at Box 610. The tubular body preferably comprises a plurality of joints, and is dimensioned to be received within a wellbore. In one aspect, the tubular body is a liner.

The tubular body also comprises a plurality of pre-drilled holes in a wall of the tubular body. The holes may be arranged in repeating patterns along the tubular body.

The tubular body is apportioned into at least a first zone, a second zone, and a third zone. This is shown in Box 620. In one aspect, the tubular body extends at least 30 feet (9.1 meters) along each of the first, second, and third zones, and preferably at least 50 feet (15.2 meters).

The pre-perforated tubular body includes a first set of plugs. These plugs are placed in the holes along the tubular body within the first zone. Each of the plugs in the first set of plugs is fabricated to substantially dissolve upon contact with an acidic fluid within a first selected time.

The tubular body also includes a second set of plugs. These plugs are placed in the pre-drilled holes along the tubular body within the second zone. Each of the plugs in the second set of plugs is fabricated to substantially dissolve upon contact with the acidic fluid within a second selected time that is greater than the first selected time.

The tubular body may further include a third set of plugs. These plugs are placed in the holes along the tubular body within an optional third zone. Each of the plugs in the third set of plugs is fabricated to substantially dissolve upon contact with the acidic fluid within a third selected time that is greater than the second selected time. It is understood that additional zones with additional sets of plugs may also be employed. For example, an extremely long horizontal wellbore may have even four or five discrete zones, with plugs designed to substantially dissolve over increasingly long periods of time.

The method 600 also includes pumping an acidic solution into the well under pressure. This is indicated at Box 630. The acidic fluid may be, for example, hydrochloric acid, acetic acid, formic acid, or combinations thereof. The acid may be injected in a bullhead fashion. Pumping the acidic solution causes the first set of plugs to dissolve. This exposes a subsurface formation outside of the tubular body along the first zone. This further insures that the formation along the first zone is adequately treated without concern that some acidic fluid will be lost along the second and third zones.

The method 600 further includes pumping the acidic solution into the well under pressure so as to dissolve the second set of plugs. This is seen at Box 640. Injecting the acidic solution causes the second set of plugs to dissolve. This, in turn, exposes a subsurface formation outside of the tubular body along the second zone.

The method 600 also includes optionally injecting the acidic solution into the well under pressure so as to dissolve the third set of plugs. This is shown at Box 650. Injecting the acidic solution causes the optional third set of plugs to dissolve. This, in turn, exposes a subsurface formation outside of the tubular body along the third zone.

Preferably, the third zone has a measured depth that is less than the second zone, and the second zone has a measured depth that is less than the first zone. However, the inverse may apply.

The wellbore may be completed substantially vertically. Alternatively, the wellbore may be completed as a deviated wellbore. In one aspect, the deviated wellbore is completed to have a substantially horizontal portion such that the horizontal portion has a heel and a toe.

In one preferred aspect, the tubular body further comprises a fourth zone. The fourth zone has a measured depth that is greater than the first zone, and resides at the toe of a horizontal portion of the wellbore. In this embodiment, the pre-drilled holes in the tubular body along the fourth zone do not have plugs. The method then further comprises injecting the acidic solution into the well under pressure so as to contact a subsurface formation along the toe of the wellbore before the acidic solution contacts the subsurface formation along the first zone.

As can be seen, the above method provides a way to perform acid stimulation in multi-zone wells without the use of chemical diverters, viscous fluids, or mechanically-placed plugs. The method takes advantage of plugs pre-placed along a pre-drilled liner string, with the plugs being fabricated from an acid-reactive material. Certain of the plugs may be covered by a gel or reactive polymer to delay the reaction with the acidic fluid. In this way, selective zones along the liner string are tuned to dissolve at different rates. Some plugs may be fabricated so that they do not dissolve for 30 minutes, or 45 minutes, or even over ten hours after contacting acidic fluid.

A plug's rate of reaction with the acid may be a function of the properties of the rock behind the tubular body, the length of the completion interval, wellbore hydraulics, and the volume of acid desired in each zone of the completion interval. The times needed for the acid to break through a plug (that is, to dissolve the plugs enough to allow acid to flow through the corresponding perforations) in certain sections of the well may be well above ten hours. This is desirable, for example, for very long horizontal wells being treated at a low pump rate.

It is noted that packers may be placed along the outside of the perforated liner to assist in the diversion. This optional step is shown at Box 660. In addition, it is preferred that a zone be preserved along the tubular body that does not have dissolvable plugs. This means that the pre-drilled holes along the tubular body at an apportioned zone are left open. This optional step is shown at Box 670. The apportioned zone is ideally at the end of the wellbore, and allows acidic solution to be injected into the near-wellbore region before stimulation of zones that have plugs. The apportioned zone may be the third zone, or a separate fourth zone as discussed above.

The method has particular application in wells that are completed as an open-hole for the production of hydrocarbons. In one aspect, the hydrocarbon-producing formation contains carbonates. The perforated or pre-drilled liner may be run into the open-hole portion of the wellbore and placed inside another pre-drilled liner that may or may not have plugs in its pre-drilled holes.

A method of creating a liner string is also provided herein. In one aspect, the method first includes providing a first set of threaded joints. The first set of threaded joints has pre-drilled holes along a body of each of the joints, This may be, for example, in accordance with the tubular body 250 of FIG. 5A.

The method also includes providing a second set of threaded joints. The second set of threaded joints also has pre-drilled holes along a body of each of the joints. The method further includes providing a third set of threaded joints. The third set of threaded joints also has pre-drilled holes along a body of each of the joints.

The method also includes inserting plugs into each of the holes in the second and third sets of joints. This may be, for example, in accordance with the tubular body 250 of FIG. 5B. Each of the plugs for the second set of joints is designed to substantially dissolve upon contact with an acidic fluid within a first selected time. Similarly, each of the plugs for the third set of joints is designed to substantially dissolve upon contact with the acidic fluid within a second selected time that is greater than the first selected time.

In one embodiment of the method, each plug is in accordance with plug 300 of FIG. 3. In this respect, each plug is fabricated to have:

- a central body, the central body having a diameter dimensioned to closely fit within a diameter of a respective pre-drilled hole;
- a top end, the top end having a diameter that is larger than the diameter of the respective pre-drilled hole; and
- a bottom end, the bottom end having a diameter that is also larger than the diameter of the respective pre-drilled hole, and wherein the bottom end is at least partially fabricated from an elastomeric material so that it may be compressed and inserted through the respective hole.

Each of the plugs may be fabricated from, for example, sodium bicarbonate, calcite rock, chalk rock, or even acid reactive elastomeric material, or combinations thereof.

While it will be apparent that the inventions herein described are well calculated to achieve the benefits and advantages set forth above, it will be appreciated that the inventions are susceptible to modification, variation and change without departing from the spirit thereof.

What is claimed is:

1. A system for stimulating a multi-zone well, comprising:

a tubular body dimensioned to be received within a wellbore, the tubular body being apportioned into at least a first zone and a second zone;

a first set of plugs placed in pre-drilled holes along the tubular body within the first zone, the first set of plugs each comprising a first retainer to secure the respective plug in the respective pre-drilled hole from an interior surface of the tubular body, the first retainer being fabricated to dissolve upon contact with an acidic fluid within a first selected time period to permit the first plug to disengage from the respective pre-drilled hole; and a second set of plugs placed in pre-drilled holes along the tubular body within the second zone, the second set of plugs each comprising a second retainer to secure the respective plug in the respective pre-drilled hole from an interior surface of the tubular body, the second retainer being fabricated to dissolve upon contact with the acidic fluid within a second selected time period that is greater than the first selected time period to permit the respective plug to disengage from the respective pre-drilled hole.

2. The system of claim 1, wherein the tubular body comprises at least two joints.

3. The system of claim 1, wherein the tubular body extends at least 10 feet (3.0 meters) along each of the first and second zones.

4. The system of claim 1, wherein the acidic fluid comprises hydrochloric acid, acetic acid or formic acid.

5. The system of claim 3, wherein the tubular body is a wellbore liner.

6. The system of claim 3, wherein: the tubular body is further apportioned into a third zone; and the tubular body also extends at least 10 feet (3.0 meters) along the third zone.

7. The system of claim 6, wherein a third set of plugs is placed in pre-drilled holes along the tubular body within the third zone, the third set of plugs each comprising a third retainer to secure the respective plug in the respective pre-drilled hole from an interior surface of the tubular body, the third retainer being fabricated to dissolve upon contact with the acidic fluid within a third selected time period that is greater than the second selected time period to permit the respective plug to disengage from the respective pre-drilled hole.

8. The system of claim 6, wherein pre-drilled holes are placed along the tubular body within the third zone, with the pre-drilled holes within the third zone having no plugs.

9. The system of claim 6, wherein: the third zone has a measured depth that is less than the second zone; and the second zone has a measured depth that is less than the first zone.

10. The system of claim 1, wherein the tubular body resides in a substantially vertical wellbore.

11. The system of claim 1, wherein the tubular body resides in a deviated wellbore.

12. The system of claim 11, wherein: the deviated wellbore is completed to have a substantially horizontal portion; the substantially horizontal portion comprises a heel and a toe; and an apportioned zone resides proximate the toe of the horizontal portion.

13. The system of claim 12, wherein: the apportioned zone proximate the toe of the horizontal portion of the wellbore has a plurality of pre-drilled holes; and the holes in the tubular body along the apportioned zone do not have plugs.

14. The system of claim 12, wherein the first zone is the apportioned zone that resides proximate the toe of the horizontal portion of the wellbore.

15. The system of claim 1, wherein at least some of the holes in the tubular body are arranged in repeating patterns.

16. The system of claim 1, wherein the holes in the tubular body along each zone have a different spacing.

17. The system of claim 1, wherein the holes in the tubular body have different diameters from zone to zone.

18. The system of claim 1, wherein each plug is fabricated to include:

a central body, the central body having a diameter dimensioned to closely fit within a diameter of a respective pre-drilled hole in the tubular body; a top end, the top end having a diameter that is larger than the diameter of the respective pre-drilled hole in the tubular body; and a bottom end, the bottom end having a diameter that is also at least as large as the diameter of the respective pre-drilled hole in the tubular body, and wherein the bottom end is at least partially fabricated from an elastomeric material so that it may be compressed and inserted through the respective hole.

19. The system of claim 1, wherein the plugs in at least one of the first and second zones are fabricated from sodium bicarbonate, calcite rock, chalk rock, acid-reactive elastomeric material, or combinations thereof.

20. The system of claim 19, wherein the material that dissolves in the presence of the acidic fluid substantially dissolves within about 5 minutes to 10 hours after being exposed to the acidic fluid within the wellbore.

21. The system of claim 7, wherein the plugs in at least the second zone are coated with an elastomeric material to delay dissolution of the plugs in the corresponding zone.

22. A method for stimulating a multi-zone well, comprising:

setting a tubular body in a wellbore, the tubular body being apportioned into at least a first zone and a second zone, and the tubular body comprising:

a first set of plugs placed in pre-drilled holes along the tubular body within the first zone, the first set of plugs each comprising a first retainer to secure the respective plug in the respective pre-drilled hole from an interior surface of the tubular body, the first retainer being fabricated to dissolve upon contact with an acidic fluid within a first selected time period to permit the first plug to disengage from the respective pre-drilled hole; and a second set of plugs placed in pre-drilled holes along the tubular body within the second zone, the second set of plugs each comprising a second retainer to secure the respective plug in the respective pre-drilled hole from an interior surface of the tubular body, the second retainer being fabricated to dissolve upon contact with the acidic fluid within a second selected time period that is greater than the first selected time period to permit the respective plug to disengage from the respective pre-drilled hole;

injecting an acidic solution into the well under pressure so as to dissolve the first retainers associated with the first set of plugs and expose a subsurface formation along the first zone; and further injecting the acidic solution into the well under pressure so as to dissolve the second retainers associated with the second set of plugs and expose a subsurface formation along the second zone.

23. The method of claim 22, further comprising:

apportioning the tubular body into a third zone;

wherein the tubular body further comprises a third set of plugs placed in pre-drilled holes along the tubular body within the third zone, each respective plug comprising a third retainer to secure the respective plug in the respective pre-drilled hole from an interior surface of the tubular body, each of the third retainers being fabricated to substantially dissolve upon contact with the acidic fluid within a third selected time period that is greater than the second selected time period to permit the respective plug to disengage from the respective pre-drilled hole; and the method further comprises still further injecting the acidic solution into the well under pressure so as to dissolve the third retainers associated with the third set of plugs and expose a subsurface formation along the third zone.

24. The method of claim 22, wherein the material that dissolves in the presence of the acidic fluid substantially dissolves within about 5 minutes to 10 hours after being exposed to the acidic fluid within the wellbore.

25. The method of claim 22, wherein the tubular body: comprises at least two joints; and is dimensioned to be received within a wellbore.

26. The method of claim 22, wherein the acidic fluid comprises hydrochloric acid, acetic acid, formic acid, or combinations thereof.

27. The method of claim 22, wherein the tubular body is a liner.

28. The method of claim 23, wherein: the third zone has a measured depth that is less than the second zone; and the second zone has a measured depth that is less than the first zone.

29. The method of claim 22, wherein the wellbore is completed substantially vertically.

30. The method of claim 22, wherein the wellbore is completed as a deviated wellbore.

31. The method of claim 30, wherein: the deviated wellbore is completed to have a substantially horizontal portion; the substantially horizontal portion comprises a heel and a toe; and an apportioned zone resides proximate the toe and has pre-drilled holes.

32. The method of claim 31, wherein the pre-drilled holes in the apportioned zone proximate the toe do not have plugs.

33. The method of claim 31, wherein the first zone is the apportioned zone that resides proximate the toe of the horizontal portion of the wellbore.

34. The method of claim 31, wherein the first zone resides proximate the heel of the horizontal portion of the wellbore.

35. The method of claim 22, wherein the pre-drilled holes in the tubular body are arranged in repeating patterns.

36. The method of claim 22, wherein the pre-drilled holes in the tubular body along each zone have a different spacing.

37. The system of claim 22, wherein the pre-drilled holes in the tubular body have different diameters from zone to zone.

38. The method of claim 22, wherein each plug is fabricated to include:

a central body, the central body having a diameter dimensioned to closely fit within a diameter of a respective pre-drilled hole in the tubular body;

a top end, the top end having a diameter that is larger than the diameter of the respective pre-drilled hole in the tubular body; and a retainer directly or indirectly engaged with the central body, the retainer having a diameter in at least one dimension that is longer than a diameter of the respective pre-drilled hole in the tubular body to selectively retain the plug within the pre-drilled hole.

39. The method of claim 22, further comprising, after setting the tubular body in the wellbore and before stimulating one of the first and second zones, circulating at least one of a wellbore conditioning fluid, a weak acid fluid, and a non-reactive fluid into at least a portion of the wellbore.

40. A method of creating a liner string, comprising:

providing a first set of tubular threaded joints having pre-drilled holes therein;

providing a second set of tubular threaded joints also having pre-drilled holes therein;

providing a third set of tubular threaded joints also having pre-drilled holes therein;

inserting plugs into each of the holes in the first, second, and third set of joints, wherein each of the plugs comprises a retainer that is configured to substantially dissolve upon contact with an acidic fluid within at least one of a first selected time period, a second selected time period, and a third selected time period; and inserting plugs into each of the holes in another of the first, second, and third set of joints, wherein each of the plugs comprises a retainer that is configured to substantially dissolve upon contact with an acidic fluid within another of the first selected time period, the second selected time period, and the third selected time period that is different than the first selected time.

41. The method of claim 40, wherein each plug is fabricated to include:

a central body, the central body having a diameter dimensioned to closely fit within a diameter of a respective pre-drilled hole; a top end, the top end having a diameter that is larger than the diameter of the respective pre-drilled hole and a retainer engagement portion, the retainer engagement portion suitable for directly or indirectly selectively engaging the retainer with an interior surface of the liner string.

42. The method of claim 40, wherein the each of the plugs comprises sodium bicarbonate, calcite rock, chalk rock, acid-reactive elastomeric material, or combinations thereof.

43. The method of claim 40, wherein the pre-drilled holes in the first set of threaded joints do not have plugs.

44. The method of claim 40, further comprising: inserting plugs into each of the holes in the first set of joints, wherein the plugs for the first set of joints are designed to substantially dissolve upon contact with the acidic fluid within a third selected time that is less than the first selected time.

* * * * *